US005329684A

United States Patent [19]

Budet et al.

[11] Patent Number: 5,329,684

[45] Date of Patent: Jul. 19, 1994

[54] METHOD OF BURNISHING METAL PARTS, IN PARTICULAR LIGHT ALLOY WHEELS, AND APPARATUS FOR IMPLEMENTING SAID METHOD

[75] Inventors: Pascal Budet, Strasbourg; Pierre Flicker, Altorf; Guy Kremer, Strasbourg; Fabien Diederichs, Eckbolsheim, all of France

[73] Assignee: Messier-Bugatti, Villacoublay, France

[21] Appl. No.: 14,737

[22] Filed: Feb. 8, 1993

[30] Foreign Application Priority Data

Feb. 14, 1992 [FR] France ..... 92 01687

[51] Int. Cl.[5] ..... B21C 37/30

[52] U.S. Cl. ..... 29/90.01; 72/85

[58] Field of Search ..... 29/90.01, 90.5; 72/84, 72/85

[56] References Cited

U.S. PATENT DOCUMENTS 2,977,669 4/1961 Chambers ..... 29/90.01
4,747,284 5/1988 Hudson ..... 72/85
4,821,388 4/1989 Okamura et al. ..... 29/90.01
4,835,826 6/1989 Wilson ..... 29/90.01

FOREIGN PATENT DOCUMENTS 0330734 8/1988 .
881229 11/1961 United Kingdom .

*Primary Examiner*—William E. Terrell
*Attorney, Agent, or Firm*—Sixbey, Friedman, Leedom & Ferguson

[57] ABSTRACT

The invention relates to a method of burnisning for the purpose of imparting surface compression stresses to metal parts. The surface state of the region of the part that is to be burnished is measured initially, and the width of the disk to be used in the burnishing is deduced therefrom. Thereafter, the disk selected in this way is installed on a tool carrier, at the end of an associated flexure bar. Once installed in this way the disk is pressed against the part to exert a predetermined force thereon as a function of the desired surface compression stresses. Finally, burnishing proper of the part is performed using the disk. The burnishing method of the invention is particularly advantageous for use with light alloy wheels, e.g. wheels made of magnesium or of aluminum alloy.

5 Claims, 2 Drawing Sheets

METHOD OF BURNISHING METAL PARTS, IN PARTICULAR LIGHT ALLOY WHEELS, AND APPARATUS FOR IMPLEMENTING SAID METHOD

The invention relates to a method of burnishing for the purpose of imparting surface compression stresses to metal parts. Such metal parts may, in particular, be circularly symmetrical, but that is no kind of limitation on the field of application of the invention.

BACKGROUND OF THE INVENTION

It should be recalled that burnishing is a technique that performs surface plastic deformation by pressing a rotary or sliding tool against the surface of a part that has already been roughed out. As it moves, the tool compresses the microscopic peaks in the surfaces concerned into the adjacent hollows, thereby enabling said surfaces to be densified.

Burnishing thus serves simultaneously to smooth surfaces and to put such surfaces into compression. The resulting mechanical forces, both on the surface and down to a certain depth, enable the lifetime of materials and structures that are subjected to cyclic changes (fatigue) or to contact corrosion to be considerably increased. This technique appears to be even more effective than shot blasting for obtaining surface compression stress, and it very considerably increases fatigue life, resistance to corrosion under tension, and resistance to the effect of corrosion due to rubbing.

As a result, burnishing is a technique that is most advantageous for metal parts that are particularly at risk, as is the case for the wheels of aircraft landing gear, e.g. wheels made of aluminum or magnesium light alloy.

Burnishing should thus be applied to regions of parts that are subjected to heavy loading, and also to regions where stress concentrations are to be feared (circular grooves, spokes, and connection webs, for example). This operation is performed by applying a force by means of one or more rotary burnishing disks, said disk(s) often also being driven in a forwards direction. This force may be applied in a manner that is advantageous by using a disk connected to a moving tool carrier by means of a flexure bar.

Disk installations have already been proposed (EP-A-0 330 743) making use of a pair of parallel spring blades that are interchangeable, thereby enabling the thrust force to be varied by selecting spring blades of a stiffness that is most suitable for the part.

Modern burnishing techniques use a tool carrier that can be associated with a numerically-controlled machine tool. In particular, when the parts are circularly symmetrical, the machine tool is a lathe and it rotates the part to be burnished, and it has a tailstock (on which the tool carrier for the disk is mounted) that is movable along two orthogonal axes, one of which axes (perpendicular to the axis of revolution of the parts) enables the disk to be pressed against the surface to be worked, and the other axis (parallel to the above-mentioned axis of revolution) enables the disk to follow the profile of the part.

Persons skilled in the art are well aware that the force with which the disk is pressed must be adjusted as a function of the type of part concerned, and also as a function of the material from which said part is made.

However, this adjustment is difficult and essentially empirical, and optimum burnishing conditions are often found only after multiple inspections of parts after burnishing. Such inspections are generally of the destructive type, and this constitutes a non-negligible drawback when the parts are sophisticated in structure and relatively high in cost, as is the case, for example, with light alloy landing gear wheels, e.g. made of magnesium or of aluminum alloy.

For burnishing light alloy airplane wheels, U.S. Pat. No. 4,835,826 teaches the use of a burnishing disk support connected via an omega spring to the tailstock of a numerically-controlled machine, which tailstock is displaced under program control (as a function of the shape of the wheel and of the thickness of the regions concerned), with the pressure exerted by the disk then being given by the programmed displacement of said tailstock. GB-A-881 229 teaches the use of a burnishing disk support which is connected firstly by spring blades to a manually positioned tool carrier, and secondly to the rod of a pneumatic actuator having a diaphragm that exerts the required thrust pressure on the disk: in that document it is specified that such a floating resilient mount for the disk makes it possible to avoid variations in the thrust force that result from the wheel to be burnished not being exactly circular, and that a radius of curvature of 3 mm is suitable for burnishing airplane wheels.

None of those techniques makes it possible to avoid the above-mentioned inspections of parts after burnishing for the purpose of optimizing burnishing conditions.

In addition, the local deformation by compression that results from burnishing is plastic, and thus irreversible, and as a result exceeding the desired values for surface compression stresses gives rise to the burnished part being rejected.

As a result, it is necessary to increase the number of preliminary adjustments and inspections so as to achieve the best burnishing conditions, and to program accordingly the machine tool that is going to perform the burnishing process.

OBJECT AND SUMMARY OF THE INVENTION

An object of the invention is to design a burnishing method and an apparatus for implementing said method that are more effective against the above-mentioned limitations and/or drawbacks, making it possible to perform burnishing under conditions that are optimum for different types of part to be burnished and for different materials from which they are made.

More particularly, the present invention provides a burnishing method for applying surface compression stresses to metal parts, in particular wheels made of light alloy, by using a disk connected to a moving tool carrier by means of a flexure bar, wherein the method comprises the following successive steps:

a) the surface state of the region of the part to be subjected to burnishing is measured and the width of the disk for use in burnishing said part is deduced therefrom;

b) the disk selected in this way is installed on the tool carrier at the end of the associated flexure bar;

c) the disk installed in this way is pressed against the part concerned by exerting a predetermined force on said disk as a function of the desired surface compression stresses; and d) burnishing proper of the part with the above-specified disk is then performed.

Preferably, in step a), a curve is used that has been pre-established for the type of part concerned and for the material of said part, said curve giving optimum values of disk width for a determined surface state.

Also advantageously, during step b) a flexure bar is selected whose deflection is determined as a function of the force to be exerted during step c).

In a variant, when the method uses a moving tool carrier that is angularly adjustable, during step c) the angle of inclination of the disk is selected as a function of the force to be exerted.

It is also advantageous to ensure that during step d) both the deflection and the compression of the flexure bar are measured in order to verify that the burnishing forces remain within a predetermined range, said method being stopped if the forces leave said range.

The invention also provides apparatus for implementing the above-specified burnishing method, the apparatus including a disk connected to a moving tool carrier by a flexure bar, wherein the disk is removably mounted on a shaft extending the flexure bar so as to enable a disk of predetermined width to be mounted on said shaft.

Disks suitable for use have a peripheral edge that is rounded in shape. Naturally, in a variant, it will be possible for the shape to be elliptical or even angular.

It may be advantageous for the flexure bar to be connected to the tool carrier so as to enable a flexure bar of predetermined resilience to be mounted on said tool carrier.

Another way of adjusting the compliance of the tooling consists in using a moving tool carrier that is angularly adjustable in such a manner that the inclination of the disk relative to the part that is to be burnished is variable.

Also advantageously, the flexure bar is fitted with strain gauges enabling the deflection and the compression of said bar to be measured, thus enabling the forces exerted during burnishing to be monitored.

BRIEF DESCRIPTION OF THE DRAWINGS

Other characteristics and advantages of the invention appear more clearly in the light of the following description and the accompanying drawings, relating to a particular embodiment, and in which.

MORE DETAILED DESCRIPTION

Figure 1A:
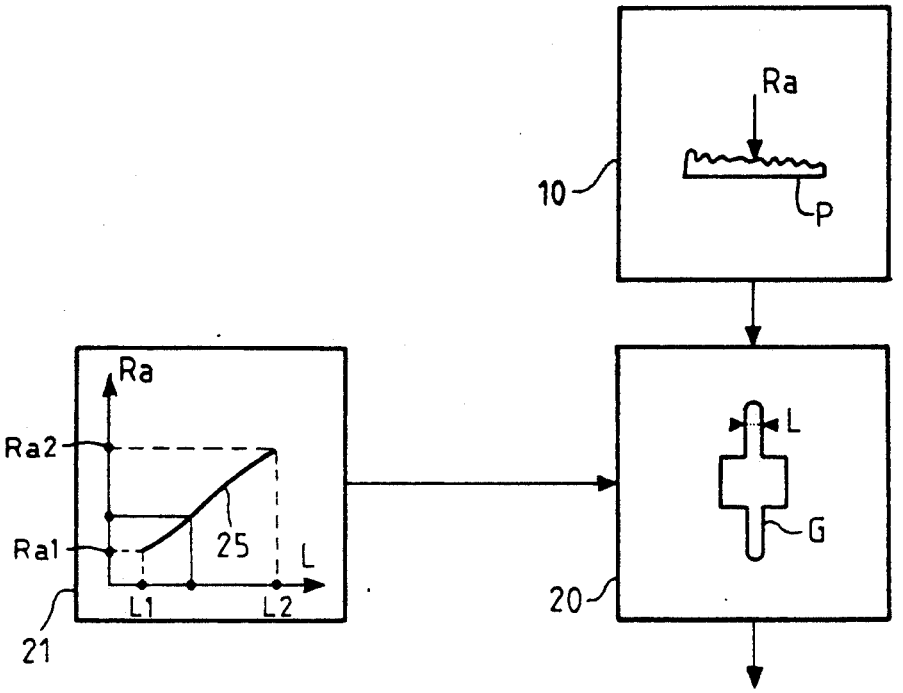
FIG. 1 (A, B, C and D) is a diagram showing the various successive steps of the burnishing method of the invention.
Figure 1B:
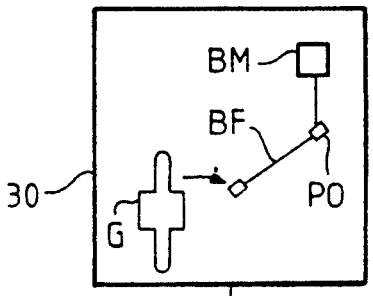
Figure 1C:
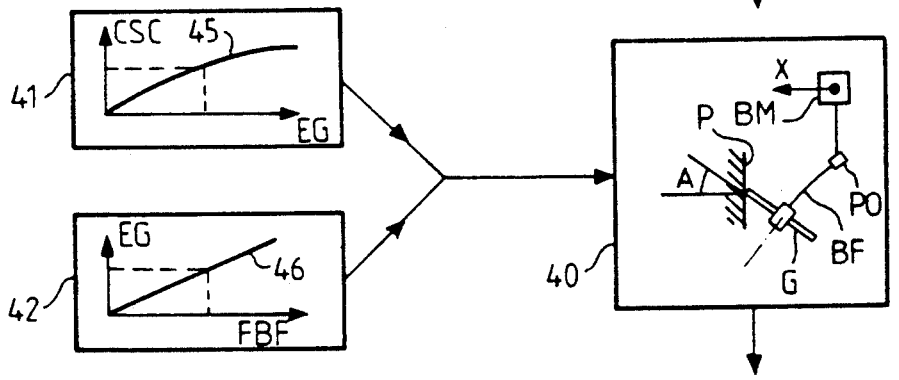
Figure 1D:
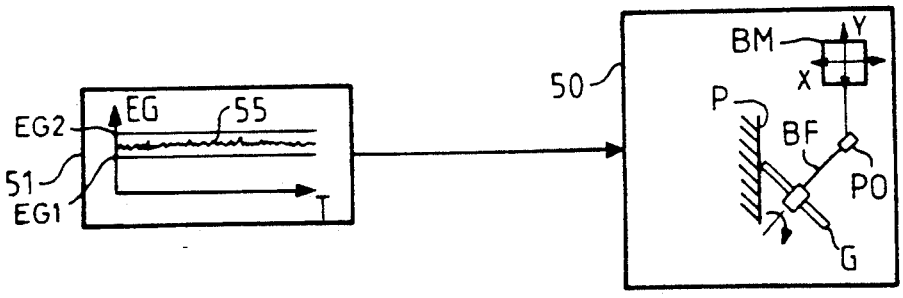

The description begins with the various successive steps of the burnishing method of the invention, with the burnishing being intended to impart surface compression stresses to metal parts, which parts may optionally be bodies of revolution.

The first step of the method, referenced a) begins with measuring the surface state of the region of the part that is to be burnished, as represented in block 10 which shows a part P whose surface state is measured (parameter Ra). This measurement of the surface state is fundamental because it makes it possible to select the functional width of the disk that is appropriate for obtaining optimum burnishing conditions for the part in question. According to a characteristic aspect of the invention, such a measurement of surface state prior to burnishing constitutes an essential parameter in determining burnishing conditions. The surface state is traditionally identified by a parameter Ra having a dimension of length.

The width of the disk to be used is determined from curves that are pre-established for each type of part to be burnished and for each type of material concerned. Block 21 thus illustrates a curve giving optimum values of disk width L for a given surface state Ra. The curve, referenced 25, relates to a particular part and to a particular material. The operator thus has a series of pre-established curves, which are preferably obtained using reject parts or raw parts having excess thickness and corresponding to the parts to be burnished. It is of interest to observe that the curve 25 is established for a predetermined range of values of the parameter Ra, between two limits Ra1 and Ra2. When the parameter Ra is below the limit Ra1, burnishing can no longer be performed since the material can no longer be made plastic with a burnishing disk (in reality, the response of the material is then practically elastic, with the compressed material springing back such that there is no work hardening). When the parameter Ra is greater than the value Ra2, that means that it is no longer possible to obtain proper work hardening of the entire surface to be burnished, i.e. it is possible only to collapse the peaks without genuinely compressing them in satisfactory manner.

Thus, measuring the parameter Ra as represented by diagram block 10 makes it possible to deduce the optimum functional width L of the disk to be used as represented by block 21, which disk is then selected from the set available to the operator as represented by block 20 which shows a disk G of functional width L selected in this way. The steps of measuring the surface state and of selecting the width of the disk to be used for the burnishing constitute the first step a) of the burnishing method of the invention.

In a following step, marked b), the disk G selected in this way is installed on a tool carrier PO connected to a moving tailstock BM. The disk is at one end of an associated flexure bar BF whose other end is fixed to said tool carrier. This installation step is represented diagrammatically by block 30, and the corresponding tooling is described in greater detail below with reference to FIGS. 2 and 3.

In a step c), the disk G installed in this way is pressed against the part concerned P by exerting a predetermined force on the disk as a function of the desired surface compression stresses. This operation is represented by block 40, in which there can be seen the disk G being pressed against the part to be burnished P, and forming an angle A therewith. The flexure BF is caused to bend by displacement of the tool carrier PO connected to the moving tailstock BM which moves along a direction X that is essentially normal to the plane of the surface P. As mentioned above, it is necessary to avoid exerting excessive force on the disk since that would give rise to surface compression stresses exceeding the desired value, leaving no possibility of recuperating the part wrongly burnished in this way.

FIG. 1 shows a preferred method of selecting the predetermined force to be exerted on the disk G as a function of the desired surface compression stresses.

For each part to be burnished and for each corresponding material, the operator has two curves available, one of which curves 45 associates a parameter CSC corresponding to surface compression stresses with a parameter EG corresponding to forces exerted on the disk, said curve being shown diagrammatically in block 41. In practice, such a curve 45 is pre-established for stress values going from 0 up to the plastification limit beyond which the material begins to crack (for an aluminum alloy, that corresponds to a value of about 400 MPa). Thus, curve 45 makes it immediately possible to determine the force to be exerted on the disk EG to obtain a given value of surface compression stresses. The operator then uses a second curve 46, shown in diagrammatic block 42, which relates the above-mentioned parameter EG to a parameter FBF relating to the deflection of the flexure bar at the disk. In this example, the curve 46 is essentially rectilinear since the flexure bar behaves like a spring, so its deflection is proportional to the force exerted. Thus, after determining the force EG to be exerted on the disk in order to obtain the desired surface compression stresses, the operator can easily determine the corresponding deflection for the flexure bar, and can program the machine tool in such a manner that the tool carrier is displaced in the direction X (which is orthogonal to the plane of the surface to be burnished) until a desired value is obtained for the deflection of the flexure bar BF. In practice, at least one strain gauge is available on the flexure bar so as to obtain an instantaneous measurement of the deflection of said bar, such that the above-mentioned programming of tool carrier displacement can be performed very easily once the operator has entered the desired value of surface compression stresses into the machine. The step shown diagrammatically in block 40 may also include selecting the angle inclination A of the disk G as a function of the force EG to be exerted. Naturally, there are several different ways in which the position of the disk G can be adjusted angularly: such angular adjustment may be the result of an additional degree of freedom for the moving tailstock BM, or it may result from a hinge on the tool carrier PO, or it may be the result of selecting the tooling to be mounted on the moving tailstock from a range having different angles of attack.

In a variant, the compliance can be adjusted by selecting a flexure bar BF whose characteristics are such that the bar has a determined deflection matching the value of FBF that corresponds to the force to be exerted on the disk G. Under such circumstances, the flexure bar BF must be removably mounted on the tool carrier PO so as to make it easy to remove and replace.

Once the preliminary steps a), b), and c) have been performed, in accordance with the method describe above, it is then possible to be begin burnishing proper of the part P with the above-mentioned disk G in application of the final step d), as shown diagrammatically in block 50. It may be observed that the diagrammatic representation of the moving tailstock BM shows degrees of freedom along two orthogonal axes X and Y, thereby enabling the disk to follow accurately the profile of the part P to be burnished.

During this step of burnishing proper, it is still possible to change the displacement of the moving tailstock BM in the X direction in order to vary the force exerted on the disk G. It is then advantageous to measure the deflection and the compression of the flexure bar BF in order to verify that the burnishing forces EG do indeed remain within a predetermined range. For example, by using strain gauges stuck on the flexure bar, it is possible to follow variations in the parameter EG as a function of time T (where the parameter EG depends directly on the parameter FBF representative of the deflection of the flexure bar). This monitoring is represented by block 51 where there can be seen a curve 55 showing variations in the parameter EG as a function of time, the values of said parameter being required to remain within a predetermined range, between predetermined limit values EG1 and EG2. If the burnishing force leaves said range, then a stop instruction is automatically given to the machine tool, thus preventing any risk of drift in the surface compression stresses actually exerted on the part while it is being burnished.

Figure 2:
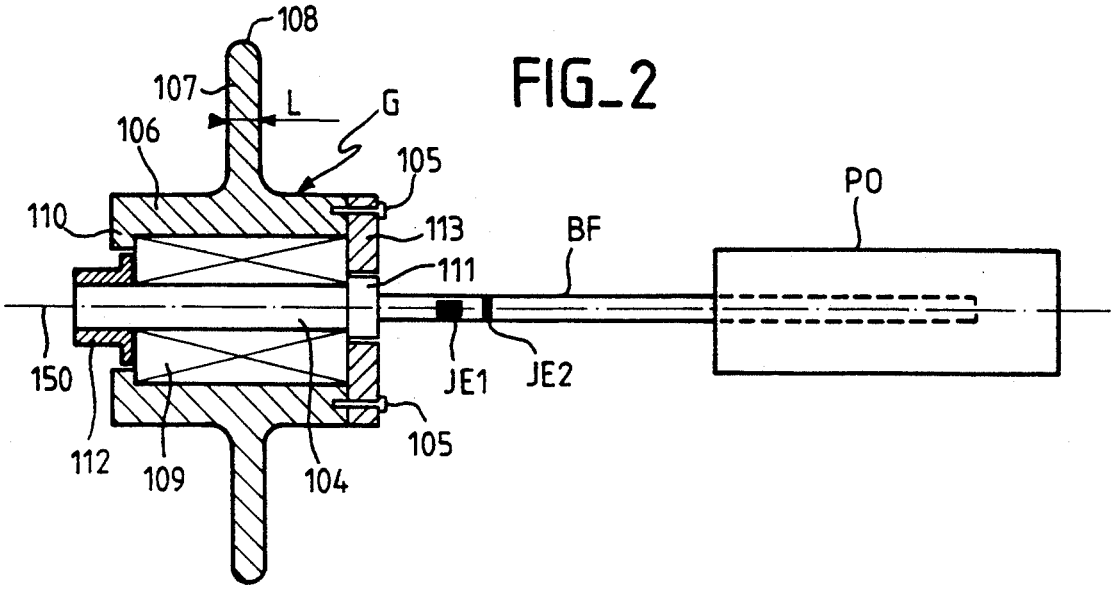
FIG. 2 is a section through burnishing tooling having a removable disk and specially designed to implement the method of the invention.

The burnishing tooling used is now described with reference to FIG. 2.

Figure 3:
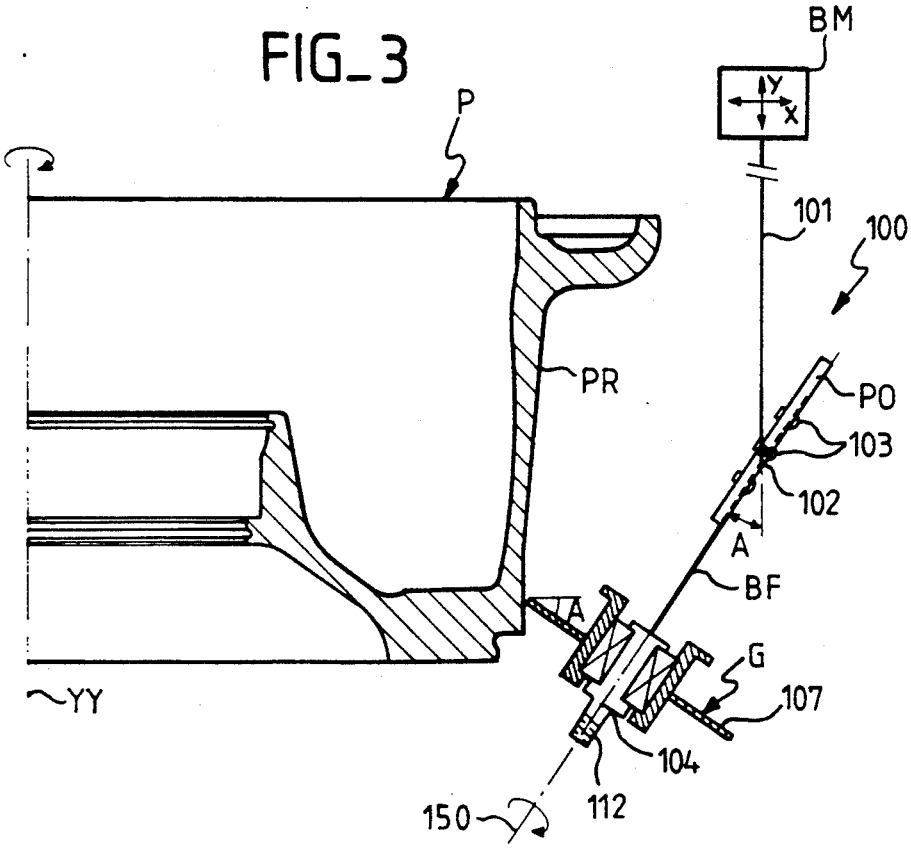
FIG. 3 shows apparatus for implementing the above-specified method, applied in this case to burnishing a wheel rim, which wheel may be made of a light alloy such as a magnesium or aluminum alloy, the apparatus including a moving tool carrier associated with a numerically controlled machine (not shown).

The tooling includes a tool carrier PO in which a flexure bar BF is engaged, preferably being secured by releasable means so as to make it possible to change the flexure bar. In FIG. 3, bolts 103 are shown for fixing the flexure bar BF on the tool carrier PO. The tool carrier may be a spring blade that is rectangular or otherwise, having a cross-section that is selected as a function of the desired second moment of area. The flexure bar BF is extended by an end shaft 104 on which the disk G is mounted by means of a ball bearing 109.

According to an essential characteristic of the invention, the disk G is removably mounted on the shaft 104 so as to enable a disk of predetermined width L to be mounted on said shaft. The disk thus includes a central hub 106 engaged on the associated bearing 109, with axial fastening being provided firstly by a shoulder 110 on the hub 106 and secondly by an endplate 113 which is fixed by removable means such as bolts 105 to the hub of the disk. The bearing 109, and consequently the disk G, is held axially by a ball abutment 111 secured to the shaft 104, and at the end of said shaft by a fixing nut 112 or the like. The disk G is thus free to rotate about its axis 150, and it has a web 107 with an active edge referenced 108. The peripheral edge 108 is rounded so as to be semicircular in shape in this case, but it would naturally be possible to select other shapes, e.g. a shape that is elliptical or even angular. More generally, this shape can be optimized case by case as a function of the parts to be burnished and the materials concerned.

Two strain gauges JE1 and JE2 are also shown stuck to the flexure bar BF and enabling the deflection and the compression of the flexure bar BF to be measured, thus making it possible to monitor the forces exerted during burnishing.

FIG. 3 shows a part to be burnished P which is constituted in this case by the rim of a wheel, and reference PR designates the profile of the region to be burnished. The component members of the burnishing apparatus 100 as already described above can be seen, including a moving tailstock BM supporting the tool carrier PO via a member 101 which is represented in this case in the form of a bar. The connection 102 between the bar 101 and the tool carrier PO could optionally be hinged so as to make it possible to vary the angular inclination of the disk G relative to the part to be burnished, i.e. so as to vary the angle A between the disk and the normal to the surface to be burnished, which in this case is perpendicular to the axis of rotation YY of the part P, which part is a body of revolution. Once the preliminary adjustments have been performed in application of the method described above with reference to FIG. 1, the part P is rotated about its axis YY, thereby causing the disk G which is pressed against it to rotate about its own axis 150. The displacements of the moving tailstock BM along the directions X and Y are programmed so that the disk G follows the profile PR of the part to be burnished, while maintaining the pressure with which said disk is applied at the desired value.

FIG. 3 also shows the fixing bolts 103 associated with the flexure bar BF, with such bolts naturally constituting merely an example for making it clear that the flexure bar can be mounted on the tool carrier PC in removable manner so as to make it possible to install a flexure bar of predetermined resilience on said tool carrier.

In practice, the value selected for the angle A will depend on the type of compliance that is desired: the angle A is chosen to be small if it is desired to give precedence to deflection of the flexure bar BF, or on the contrary it will be large (i.e. close to 90°) if it is desired to give precedence to compression of said flexure bar (in which case the effects of compliance are practically lost).

A method of burnishing and apparatus for implementing said method are thus provided which make it possible to perform burnishing under optimum conditions for different types of part to be burnished and for different component materials. The preliminary adjustments are now considerably simplified and, in addition, any risk of exceeding the surface compression stresses is avoided. Once burnishing has been completed, there is no need to inspect the final surface state which is in any event better than the surface state as measured prior to burnishing for the purpose of selecting the proper width of disk to use.

In addition, it is possible to modify operating conditions while burnishing is taking place, e.g. the force exerted on the disk or the angle of inclination of said disk, or even to change the tooling. In any event, the burnishing method of the invention makes it possible to perform burnishing at all possible inclinations of the surfaces to be burnished (horizontal, vertical, or inclined). By monitoring the deflection and the compression of the flexure bar, it is possible to ensure that the burnishing forces remain within an appropriate predetermined range. In the event of excessive drift from the selected nominal value, a signal is automatically sent to the machine tool to cause it to stop, and this constitutes an advantageous security feature when the parts concerned are sophisticated in shape and expensive to manufacture.

The burnishing method of the invention thus always make it possible to select a disk which enables the desired value of surface compression stresses to be obtained with great accuracy, while also improving the surface state compared with the state prior to burnishing.

The invention is not limited to the embodiment described above, but on the contrary extends to any variant that uses equivalent means to reproduce the essential characteristics specified above.

We claim:

1. A burnishing method for applying surface compression stresses to metal parts, in particular wheels made of light alloy, by using a disk connected to a moving tool carrier by means of a flexure bar, wherein the method comprises the following successive steps:

a) the surface state of the region of the part to be subjected to burnishing is measured and the width of the disk for use in burnishing said part is deduced therefrom;

b) the disk selected in this way is installed on the tool carrier at the end of the associated flexure bar;

c) the disk installed in this way is pressed against the part concerned by exerting a predetermined force on said disk as a function of the desired surface compression stresses; and d) burnishing proper of the part with the above-specified disk is then performed.

2. A method according to claim 1, wherein in step a), a curve is used that has been pre-established for the type of part concerned and for the material of said part, said curve giving optimum values of disk width for a determined surface state.

3. A method according to claim 1, wherein during step b) a flexure bar is selected whose deflection is determined as a function of the force to be exerted during step c).

4. A method according to claim 1, in which the moving tool carrier is also angularly adjustable, the method being wherein during step c) the angle of inclination of the disk is selected as a function of the force to be exerted.

5. A method according to claim 1, wherein during step d) both the deflection and the compression of the flexure bar are measured in order to verify that the burnishing forces remain within a predetermined range, said method being stopped if the forces depart from said range.

* * * * *